United States Patent [19]

Oguro

[11] 4,164,684

[45] Aug. 14, 1979

[54] MAGNETRONS

[75] Inventor: Tomokatsu Oguro, Mobara, Japan

[73] Assignee: Hitachi, Ltd., Tokyo, Japan

[21] Appl. No.: 865,917

[22] Filed: Dec. 30, 1977

[30] Foreign Application Priority Data

Jan. 5, 1977 [JP] Japan ..... 52-61[U]

[51] Int. Cl.[2] ..... H01J 25/50

[52] U.S. Cl. ..... 315/39.51; 313/40; 313/45; 315/39.75

[58] Field of Search ..... 313/40, 45, 46; 315/39.51, 39.75, 39.71

[56] References Cited

U.S. PATENT DOCUMENTS

| | | | |
|---|---|---|---|
| 2,289,984 | 7/1942 | Mouromtseff | 313/45 X |
| 2,431,157 | 11/1947 | Zelinka | 313/45 X |
| 2,849,633 | 8/1958 | Crapuchettes | 313/45 |
| 2,852,715 | 9/1958 | Rich | 313/45 X |
| 3,493,810 | 2/1970 | Valles | 315/39.51 |
| 3,967,154 | 6/1976 | Tashiro et al. | 315/39.71 |

*Primary Examiner*—Saxfield Chatmon, Jr.
*Attorney, Agent, or Firm*—Charles E. Pfund

[57] ABSTRACT

A cylindrical envelope of the magnetron is provided with annular grooves about its periphery and each of the cooling fins and the mounting plate is provided with an annular member press fitted on the envelope and an integral bent rim which engages the groove.

7 Claims, 6 Drawing Figures

MAGNETRONS

BACKGROUND OF THE INVENTION

This invention relates to a magnetron, and more particularly to the improvement of outer members force fitted onto the main body of the magnetron.

Magnetrons are widely used for defreezing and heating foodstuffs since they can generate efficiently microwaves when incorporated into microwave ovens. In most prior art magnetrons, parmanent magnets are arranged on the outside of the evacuated envelope but in recent years, research has been made to install the magnets within the envelope for the purpose of miniaturizing the magnetron and improving the productivity and reliability.

FIG. 1 is a longitudinal sectional view showing the basic construction of one example of a prior art magnetron comprising an evacuated envelope, a cylindrical anode electrode 1*a* contained in the envelope and provided with a plurality of radial vanes 1*i*, permanent magnets 1*b* and 1*c* supported by supporters 1*e* and 1*f* at the upper and lower ends of the anode electrode, a cathode electrode 1*d* concentrically contained in the anode electrode, a cathode lead 1*g* for supplying heating current to the cathode electrode, an output electrode 1*h* or antenna for radiating the microwave created in the resonator comprised of vanes of the anode electrode.

On the outer periphery of the envelope is secured a mounting plate 2 for mounting the magnetron on a microwave oven, not shown, heat radiating fins 3 for dissipating the heat generated by the anode electrode 1*a*, and a filter casing 4 for shielding the cathode lead 1*g* through their annular portions 2*a*, 3*a* and 4*a* respectively as by force fitting or shrink fitting. Waveguide members 6*a* and 6*b* are secured to the mounting plate 2 with a gasket 5 interposed therebetween by means of screws 7 so as to cover the antenna 1*h*. In other words, the magnetron is suspended from the waveguide through the annular portion 2*a* of the mounting plate 2.

With the construction described above, however, problems arise when the inner diameter of the annular portion or the outer diameter of the envelope is not accurate. Particularly, since the main body 1 of the magnetron is supported only by the mounting plate 2 with its annular portion 2*a* force fitted on the outer periphery of the envelope, the envelope would be withdrawn from the mounting plate if an excessive force is applied to the envelope in the axial downward direction thereof when the waveguide member 6*b* presses down the envelope through the gasket 5 as the screws 7 are tightened. As the cooling fins 3 are formed by pressing metal sheets (usually aluminum sheets), their upright flanges 3*a* often become irregular and eccentric thus forming air gaps between the flanges and the envelope which decreases heat dissipation. Further such flanges are deformed due to heat generated during the operation.

SUMMARY OF THE INVENTION

It is an object of this invention is to provide an improved magnetron wherein component parts such as cooling fins and mounting plate are firmly secured to the periphery of the cylindrical main body of the magnetron irrespective of inaccurate machining or eccentricity.

According to this invention, there is provided a magnetron of the type comprising a cylindrical main body containing anode and cathode electrodes and permanent magnets, and component parts mounted on the periphery of the main body, wherein each of the component parts is provided with an annular member press fitted on the main body and having an inner diameter equal to or a little smaller than the outer diameter of the main body, and the main body is provided with a groove around the outer periphery thereof for engagement with a portion of the annular member.

DESCRIPTION OF THE PREFERRED EMBODIMENT

Figure 1:
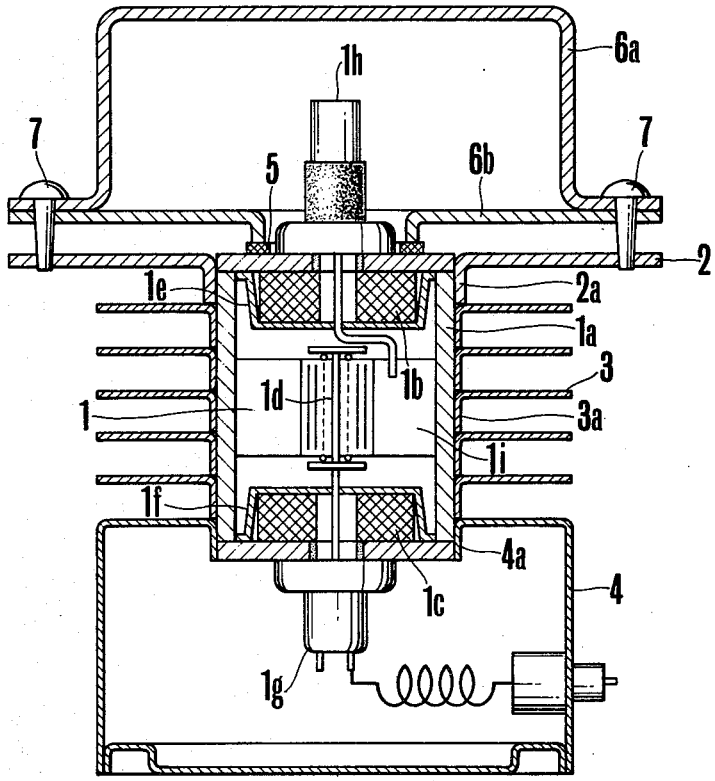
FIG. 1 (PRIOR ART)
FIG. 1 is a diagrammatic view, partly in section, showing a prior art magnetron.
Figure 2:
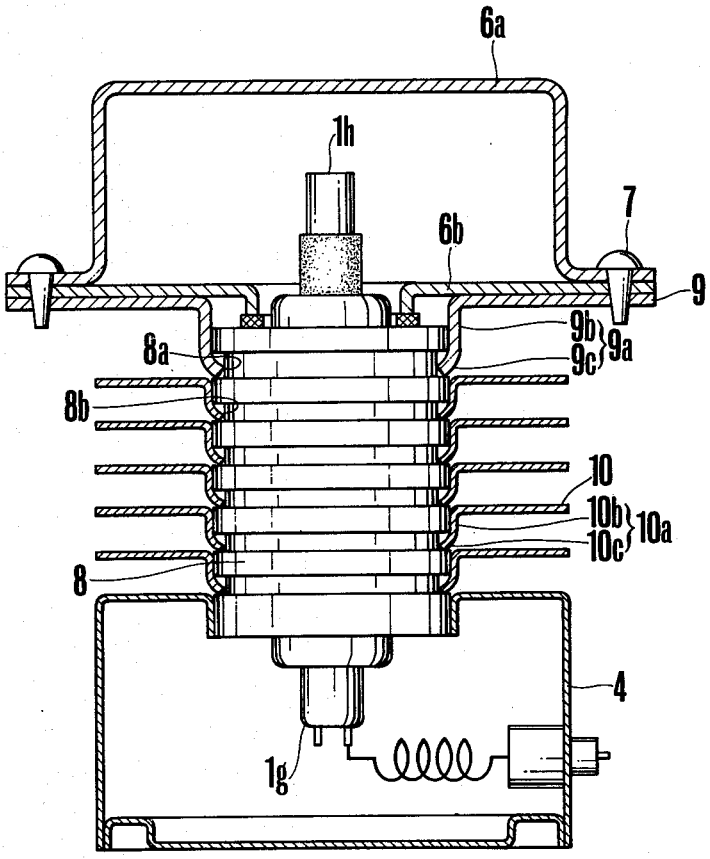
FIG. 2 is a diagrammaic view, partly in section, showing one embodiment of the magnetron of this invention.
Figure 3A:
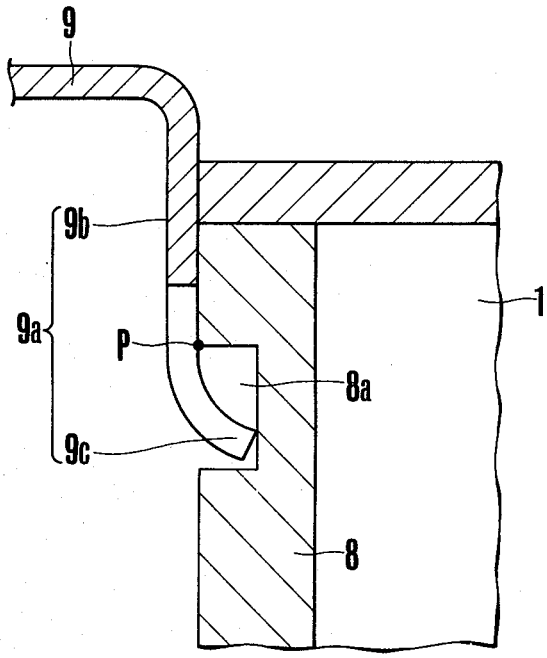
FIG. 3A is an enlarged sectional view showing certain portions of the magnetron of this invention.
Figure 3B:
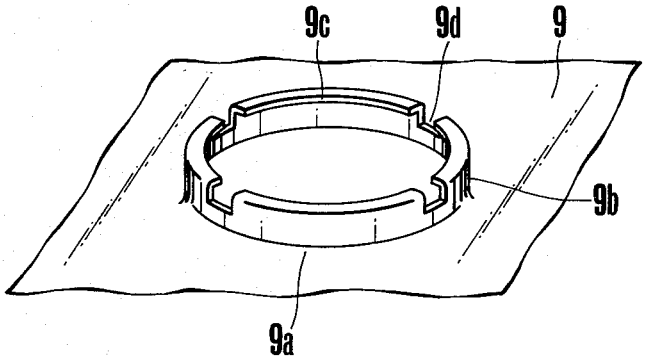
FIG. 3B is a perspective view showing a mounting plate utilized in this invention.

In FIG. 2 which shows a preferred embodiment of this invention, elements corresponding to those shown in FIG. 1 are designated by the same reference numerals for the sake of avoiding duplicate description. The main body of the magnetron 8 is formed with grooves 8*a* and 8*b* having different width at a definite spacing around its cylindrical surface. As shown in FIGS. 3A and 3B, the annular portion 9*a* of the mounting plate 9 (usually made from steel plate) comprises a cylindrical flange 9*b* having an inner diameter a little smaller than or substantially equal to the outer diameter of the main body 8 and a bent rim 9*c* formed by inwardly bending the edge of the flange 9*b*. The bent rim 9*c* is provided with four slots or notches 9*d* (to facilitate the bending of the rim after the annular portion has been press fitted on the envelope as will be described later) and has a smaller inner diameter than that of flange 9*b* which is substantially the same as the inner diameter of the grooves 8*a*. The annular portion 10*a* of each cooling fin 10 has substantially the same construction as the annular portion 9*a* of the mounting plate 9 and is provided with a cylindrical flange 10*b* and a bent rim 10*c* which is provided with slots, not shown, corresponding to slot 9*d* shown in FIG. 3B. The mounting plate 9 and the cooling fins 10 are firmly mounted on the main body by press fitting their annular flanges 9*b* and 10*b* on the periphery of the main body.

Then the bent rims 9*c* and 10*c* engage the recesses 8*a* and 8*b* respectively formed in the periphery of the main body at a circumferential area P (see FIG. 3A) so that they may serve as a stopper against a liable axial downward movement of the envelope caused when the screws 7 are tightened. These bent rims can be readily formed by press work at low cost.

In a preferred example, for the envelope having a diameter of 45 mm, the groove 8*a* has a depth of about 1.5 mm and a width of about 2.5 mm.

Figure 4:
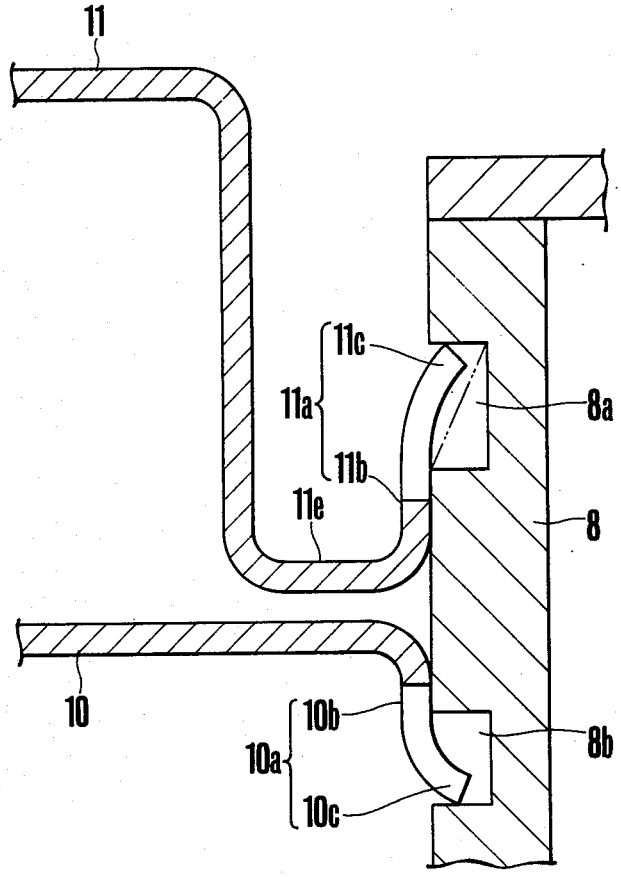
FIG. 4 is a sectional view showing certain portions of a modified embodiment of this invention.

In a modified embodiment shown in FIG. 4, the annular portion 11*a* of the mounting plate to be fitted on the main body of magnetron comprises a cylindrical flange 11*b*, a bent rim 11*c* and slots not shown but corresponding to the slots 9*d* shown in FIG. 3B. The sectional view shown in FIG. 4 is taken through the slot. In this embodiment, the annular portion 11*a* emerges into the mounting plate 11 through an cup-shaped connecting portion 11*e*. Different from the embodiment shown in FIG. 3A, the flange 11*b* extends upwardly so that the upper end of the bent rim 11*c* engages the upper wall of recess 8*a*. This construction prevents more positively dropping of the main body of the magnetron. Specifically, in this embodiment, the bottom of groove 8*a* may be raised toward the lower wall as illustrated at a phantom line in FIG. 4. For the purpose of a stopper, the tip of bent rim 11*c* will engage the upper wall of groove 8*a* after the screw 7 has been fully tightened while, prior to the tightening of screw, the presence of a slight gap between the upper wall and the tip of the bent rim will be allowed.

Although in the foregoing description slots are provided for bent rims 9*c*, 10*c* and 11*c*, where the length of these flanges 9*b*, 10*b*, 11*b* is long, it is not necessary to provide such slots. Further, instead of being previously bent, the rim may be bent inwardly after fitting the flange on the envelope. The formation of slots in the rim is particularly advantageous for facilitating the inward bending of the rim following the press fitting of the flange as in this case. The annular grooves 8*a* and 8*b* can also receive and secure other component part. They need not be continuous around the periphery of the main body but may be intermittent.

Figure 5:
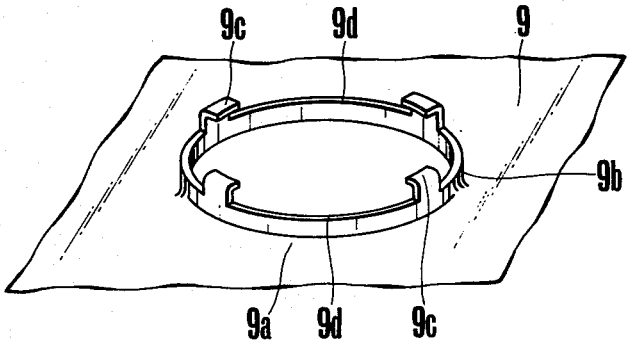
FIG. 5 is a perspective view showing a modified mounting plate utilized in this invention.

FIG. 5 shows a further modified embodiment in which one or more (four in the figure) bent rims 9*c* each having a small width are formed. That is, the bent rim has a smaller width than that of the slot 9*d*. Preferably, the width and height of this bent rim are respectively dimensioned about 3 mm for 45 mm diameter envelope. This modification is sufficient for use with the modification of FIG. 4 in which the tip of the bent rim directly engages the upper wall of groove to act as a stopper against the axial downward movement of the envelope.

As described above, according to the invention, it is possible to firmly secure such component parts as cooling fins and mounting plate on the main body of the magnetron irrespective of inaccurate machining and eccentric configuration.

What is claimed is:

1. In a magnetron of the type comprising a cylindrical main body containing anode and cathode electrodes and permanent magnets, and component parts mounted on the periphery of said main body, the improvement wherein each of said component parts is provided with an annular member press fitted on said main body and having an inner diameter equal to or a little smaller than the outer diameter of said main body and said main body is provided with at least one, annular, circumferential groove around the outer periphery thereof for engagement with a portion of said annular member.

2. The magnetron according to claim 1 wherein said component part comprises a mounting member.

3. The magnetron according to claim 1 wherein said component part comprises cooling fins.

4. The magnetron according to claim 1 wherein said annular member is provided with a flange and an inwardly bent rim for engagement with said groove.

5. The magnetron according to claim 1 wherein a slot is provided for said groove engaging portion of said annular member.

6. The magnetron according to claim 5 wherein said groove engaging portion has a smaller width than that of said slot.

7. The magnetron according to claim 2 wherein said annular member emerges into a mounting portion of the mounting member through a cup-shaped connecting portion and extends upwardly to engage the upper wall of said groove.

* * * * *